US006971943B1

(12) United States Patent
Schulze

(10) Patent No.: US 6,971,943 B1
(45) Date of Patent: Dec. 6, 2005

(54) INTERACTIVE SOUND PRODUCING TOY

(76) Inventor: Arne Schulze, 129 Marguerita Ave., #R, Santa Monica, CA (US) 90402

( * ) Notice: Subject to any disclaimer, the term of this patent is extended or adjusted under 35 U.S.C. 154(b) by 0 days.

(21) Appl. No.: 10/914,839

(22) Filed: Aug. 9, 2004

Related U.S. Application Data

(63) Continuation-in-part of application No. 10/675,030, filed on Sep. 30, 2003, now abandoned.

(51) Int. Cl.[7] ..... A63H 3/14
(52) U.S. Cl. ..... 446/327; 446/175
(58) Field of Search ..... 446/327–329, 446/175, 297, 484; 340/384.3, 384.4, 384.7

(56) References Cited

U.S. PATENT DOCUMENTS

| | | | | |
|---|---|---|---|---|
| 3,092,927 A | | 6/1963 | Luchsinger | |
| 4,206,448 A | | 6/1980 | Davis | |
| 4,221,927 A | * | 9/1980 | Dankman et al. | 367/198 |
| 4,290,053 A | | 9/1981 | Nemoto | |
| 4,314,423 A | * | 2/1982 | Lipsitz et al. | 446/303 |
| 4,551,114 A | * | 11/1985 | Hyman et al. | 446/397 |
| 4,687,457 A | * | 8/1987 | Milner | 446/175 |
| 5,130,693 A | * | 7/1992 | Gigandet | 340/815.69 |
| 5,447,461 A | * | 9/1995 | Liao | 446/301 |
| 5,463,369 A | * | 10/1995 | Lamping | 340/384.7 |
| 5,471,192 A | * | 11/1995 | Dash | 340/384.3 |
| 5,633,985 A | | 5/1997 | Severson et al. | |
| 5,944,533 A | * | 8/1999 | Wood | 434/322 |
| 6,394,874 B1 | * | 5/2002 | Kubo et al. | 446/327 |

* cited by examiner

*Primary Examiner*—Bena Miller
(74) *Attorney, Agent, or Firm*—Richard S. Erbe

(57) ABSTRACT

A sound-producing toy configured to represent a living being having movable parts to simulate a natural form of animation of a mouth includes a sound-producing unit operable in the response to the simulated animation. Animation may be simulated by a hand inserted in the toy, by operation of an actuator incorporated in the toy, or by a remote control device. The apparatus includes a switch that activates a sound-producing unit, which produces a sequence of syllables that is capable of being synchronized with the animation of the mouth. The onset, coda, and duration of each syllable's nucleus is controlled by the user of the toy with the ability to synchronize visual animation and the vocal performance of a familiar song, poem, or other series of verbal audio events divided into individual syllables, in a totally realistic manner. In another aspect of the invention, a musical instrumental sequenced performance may be synchronized with the vocal presentation and the synchronized visual animation of the toy.

20 Claims, 5 Drawing Sheets

INTERACTIVE SOUND PRODUCING TOY

RELATED APPLICATIONS

This application is a continuation-in-part application of U.S. patent application Ser. No. 10/675,030, filed Sep. 30, 2003 now abandoned.

BACKGROUND OF THE INVENTION

1. Field of the Invention

The present invention relates generally to producing audio in response to stimuli, and more particularly to generating a recognizable verbal sound or series of verbal sounds in complete synchronization with animation, such as with a manually controlled puppet figure.

2. General Background and State of the Art

Novelty items, such as greeting cards, toys and puppets which have mouths or opposed moving members and which are also capable of producing voice-like sounds are known in the art. One of the primary objects of such items is to give the user the impression that the item is actually "speaking" or "singing" in conjunction with the movement of the mouth or jaws as they are moved by the user and thus providing the user with more accurate control over the verbal audible events produced by the toy or puppet.

For example, U.S. Pat. No. 4,768,232 to Milner discloses a hand-held puppet figure configured to represent a living being having hand-controllable moving parts to simulate some form of animation of the figure's mouth. The figure is provided with sound-generating apparatus. A sensor in the form of a light-sensitive photocell is mounted in the figure's mouth to allow hand-controlled animation of the puppet to vary the light received by the photocell to produce a signal indicative of mouth movement by detecting changes in light. A frequency generator, including a voltage-controlled oscillator responsive to a voltage derived from an output counter, produces a tone signal having a pseudo-randomly varying frequency in the audio range. The tone signal is applied to a modulator and used to modulate the signal produced by the photocell, resulting in an audio signal having a pseudo-randomly varying pitch component, not controllable by hand movements, and an amplitude (loudness) that is variable by hand movement. When applied to a speaker, a pseudo-articulate simulated sound is produced, such as quacking or barking. The user of the figure can produce a sound, the loudness of which is coordinated with the hand-controllable parts. The sound produced is not a spoken or sung voice simulating any form of understandable speech.

U.S. Pat. No. 5,651,716 to Mowrer, et al., discloses a sound modulating toy figure that includes resilient jaw members movable between open and closed positions. The jaw members are operated by using a manual lever-type actuator. The toy also includes a sound-producing unit including a speaker. The operator of the toy pushes a manual switch to activate the sound-producing unit thereby producing an audible sound. A muffler mounted near the speaker muffles the sound when the jaw members of the toy are closed and allows substantially all of the sound to emanate from the speaker when the jaw members are opened.

U.S. Pat. No. 5,447,461 to Liao discloses a sound generating hand puppet, which includes a glove worn by a player and a mouth-manipulating device secured in the head portion of the puppet glove. A sound generator mounted in the puppet is activated by operation of the mouth-manipulating device, which simulates opening the mouth of the puppet. This operation produces a sound imitating an animal or person's cry.

U.S. Pat. No. 6,394,874 to Kubo, et al., discloses a sound-generating finger puppet, which can be operated by a single hand. The figure includes a sound-producing unit within the puppet that is activated by pushing a button. The puppet does not include moving jaw members.

U.S. Pat. No. 5,471,192 to Dash discloses an animal figure, such as a cat, that includes a sensor and sound producing circuitry. When a user stimulates the sensor, by "petting" the figure, the output wave of an oscillating waveform may be controlled by the user. The resulting sound is an audible oscillating "rrrr" or purring sound. The characteristics of the continuous oscillating waveform do not change; only the amplitude of the sound changes. Dash does not disclose or suggest producing understandable speech in conjunction with animating parts of a toy figure.

All of the above devices provide the user with an enjoyable experience by combining a form of animation of the toy figure with sound, adding some aspect of realism to a game being played with the figure.

However, these prior art devices do not provide any form of synchronized verbal audio sequenced content with the animation of the toy or other novelty item. In the real world, when a user manipulates the mouth or jaw elements of the item, the mouth may be open for a very short duration or a long duration, or somewhere in between, depending on the whim of the user, or the type of game being played. Thus, to truly simulate the synchronization of physical animation with verbal sound, the sound producing unit of the item would have to be capable of responding to a variety of length of animation events, so that the beginning of the sound commences with the opening of the mouth or jaw elements of the figure, continues for the period of time that the mouth or jaw elements are open, and ends naturally as the mouth or jaw elements are closing, with the natural syllable tail end and sound decaying as does a natural speaking or singing voice when a speaker's or singer's mouth is closed.

Thus, there has long been a need for a sound producing novelty item that combines truly synchronized verbal audio and animation that provides the impression that the item is actually "speaking" or "singing" as each syllable of the verbal audio commences upon animating the item, continues for as long as the animation continues, and, most importantly, ends naturally.

None of the above patents, taken either singly or in combination, is seen to describe the present invention as disclosed and claimed.

SUMMARY OF THE INVENTION

Accordingly, it is an object of the invention to provide a novelty item or toy figure having movable members that produce verbal speech or singing as the members are moved to simulate that audio is emanating from the item's moving members.

Another object of the invention is to provide a novelty item or toy figure having movable members, which produces verbal speech or singing in complete synchronization as the item's members are opened, remain opened, and closed.

A further object of the invention is to provide a novelty item or toy figure having a head portion with movable members whereby animating the movable members, a pre-recorded verbal syllable is actuated.

It is also an object of the invention to provide a novelty item or toy figure having a controllable vocal synchronization between each syllable's segments and animation when opening, holding open, and closing the mouth of the item, thereby actuating a visually correct vocal performance with total control of each syllable's segments and thereby the vocal performance tempo.

Yet another object of the invention is to provide a novelty item or toy figure having a mouth and a sound-producing unit that uses sustainable resynthesized looped vowels where all syllables are time length manually controllable by a player.

A further object of the invention is to provide a toy figure or novelty item having a mouth and a sound producing unit where the sequence of verbal audio events are actuated and controlled by opening and closing the item's mouth manually thus resulting in an animated sequence for each and every syllable pronounced in the speech or song within a prerecorded digital verbal audio file.

These and other objectives are achieved by the present invention, which, in a broad aspect, provides the user with a sound-producing apparatus for use in conjunction with a toy in the form of a puppet having hand-movable parts simulating animation to provide controllable vocal performances that are synchronized with the manually controlled animation of the puppet. The invention includes a switch configured so as to produce a signal when certain hand-movable parts are moved that actuates a sound-producing unit mounted within the toy. The sound-producing unit produces an audio event that, when applied to a speaker, produces sound controllable by hand movements and coordinated to the animation of the puppet.

In the preferred embodiment of the invention a switch is mounted in the toy figure's mouth. The switch activates a sound producing unit in the form of a sound chip on which are stored a number of audio events in the form of words that are composed of syllables. The syllables, in turn, normally, are composed of sub-syllabic units called onsets and rhymes. The rhymes may be further defined as having individual phonemes called the nucleus and coda, which are the smallest units of sound analysis. As these syllable segments are activated in sequence, they produce a recognizable word, phrase, poem, or song through a speaker mounted in the figure. Thus, each syllable is made up of three distinctive segments: 1) a beginning called the "onset" that is activated as the mouth of the figure opens; 2) a sustainable resynthesized looped nucleus, the central segment of the syllable, that continues for as long as the mouth is open; 3) and an end segment being either the coda, or in many cases, the natural end of the preceding nucleus, that is activated as the mouth closes and provides a natural ending of the syllable's rhyme.

A supply voltage control circuit produces the operating voltage for the electronic circuits used to implement the invention. The control circuit is structured to respond to the signal produced by the switch.

A principal advantage provided by the invention is found in the realism afforded a child's toy or other amusement device having movable parts to simulate vocalized animation. With the present invention, a player can produce recognizable verbal audio events that are truly synchronized with the movement of the toy or device.

Another advantage of the present invention is that the recognizable verbal audio events are synchronized with the movement of the mouth moving parts of the figure or device regardless of the time lapse of the movement of the mouth parts, i.e., realistic synchronization of the movement of the mouth parts and the vocal performance emanating from the figure whether the movement of the mouth parts is done rapidly or slowly, without adjusting any parts of the toy.

Further objects and advantages of this invention will become more apparent from the following description of the preferred embodiment, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiments of the invention with reference to the drawings in which.

DETAILED DESCRIPTION OF THE PREFERRED EMBODIMENTS OF THE INVENTION

In the following description of the present invention, reference is made to the accompanying drawings, which form a part thereof, and in which are shown, by way of illustration, an exemplary embodiment illustrating the principles of the present invention and how it may be practiced. It is to be understood that other embodiments of the invention may be utilized to practice the present invention and structural and functional changes may be made thereto, without departing from the scope of the present invention.

Figure 1:
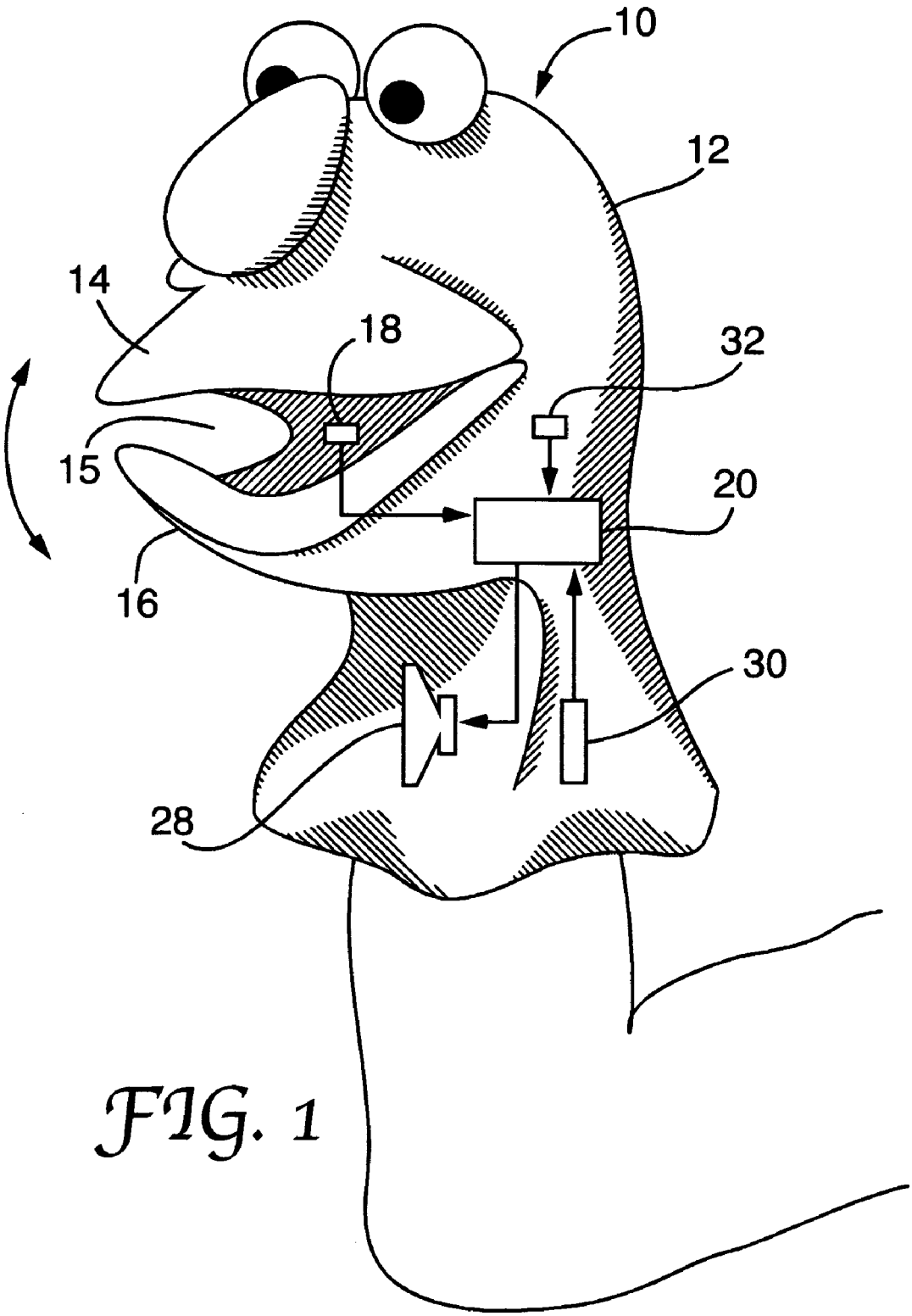
FIG. 1 illustrates a simplified diagram of an exemplary embodiment of the invention illustrating its use with a puppet.

A sound producing apparatus of the present invention is illustrated as a toy figure in FIG. 1, where the toy figure is generally referred to by the reference numeral 10. Toy 10 includes head 12, which can take the form of a living being, such as an animal, fantasy figure, or a human. In an alternative embodiment of the invention, head 12 may be embodied in a glove (not shown), which can be worn on a hand and used in conjunction with any mouth controllable hand puppet. Head 12 includes mouth 15 having opposed resilient jaw members 14 and 16, which may be operated manually by someone playing with the toy, either by inserting a hand inside head 12 or by means of a manual actuator mounted within head 12. Jaw members 14 and 16 are biased to generally remain adjacent to each other when they are not activated.

Figure 3:
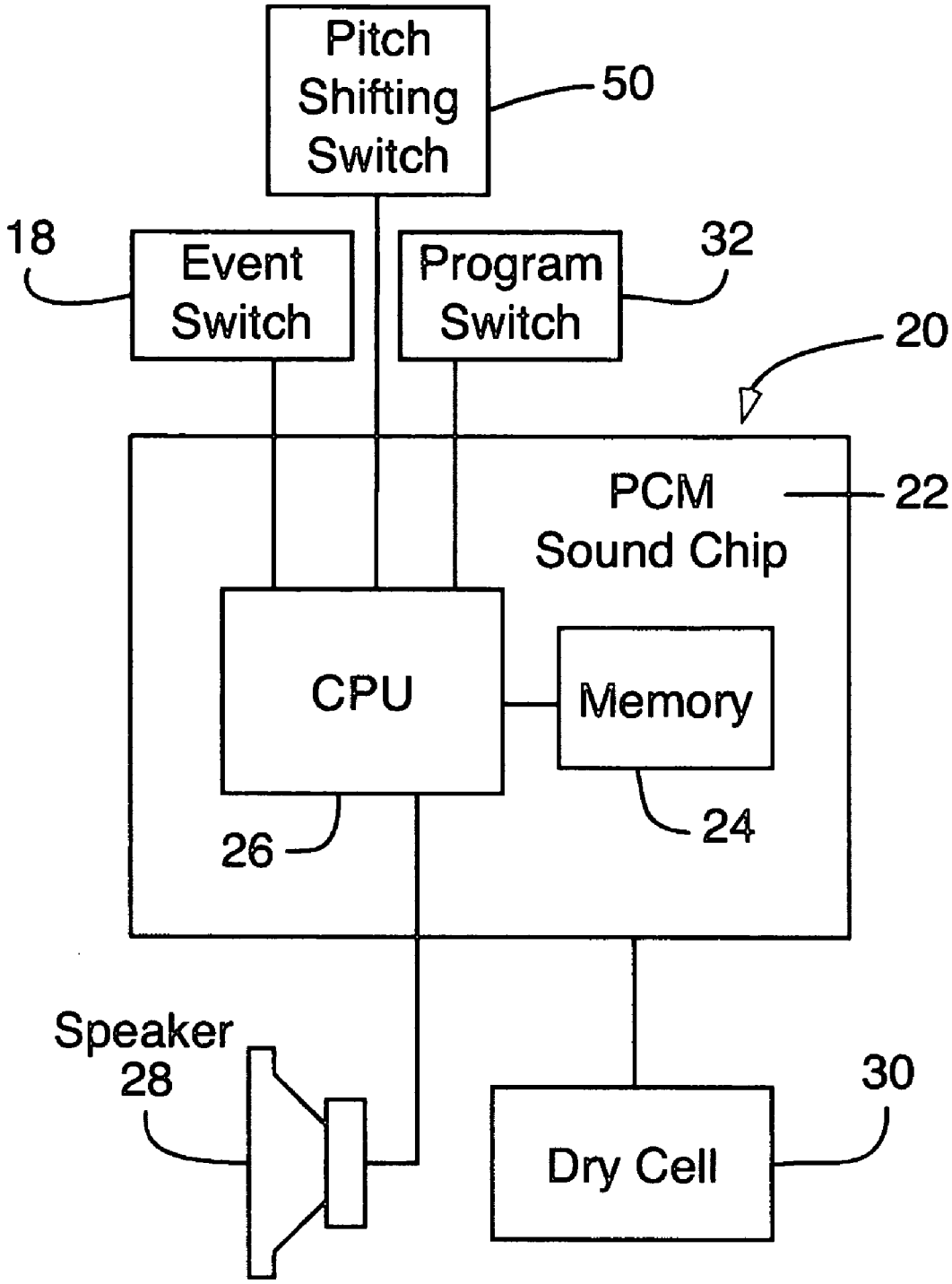
FIG. 3 is block diagram of the sound-producing unit of the invention.

Toy 10 further includes sound producing unit 20, which is illustrated in FIG. 3. Sound producing unit 20 includes sound chip 22, on which is mounted a memory 24, which may take the form of, for example, a memory chip, a ROM cartridge, or a flash RAM card, and processing unit 26. Memory 24 contains a plurality of stored verbal audio events, which, in the preferred embodiment of the invention, are comprised of verbal syllables arranged in sequences to produce recognizable songs, poems, or phrases.

Each audio event is in the form of a word having one or more syllables. A syllable is defined as a unit of sound composed of a central peak of sonority (usually a vowel) and the consonants that surround the central peak.

A syllable may be further divided into sub-syllabic units called onsets and rhymes, the onset being the first (initial) segment of a syllable (usually a consonant) and the rhyme forming the core of the syllable. The rhyme may be further defined as consisting of a nucleus (the second segment of the syllable, usually a vowel), which is the central segment of a syllable, and the coda (usually a consonant), which is the third and closing segment of a syllable. Thus, most syllables may be defined as having three segments, the initial segment (onset), the central segment (nucleus) and a closing segment (coda). When a syllable has a vowel ending, the third segment becomes the natural tail-end of the nucleus.

As these three syllable segments or multiple syllable segments are activated in sequence, they produce a recognizable word, phrase, poem or song through speaker 28. When the player begins to manually animate toy 10 by moving mouth 15 jaw members 14 and 16, switch 18 send a signal to sound producing unit 20 to initiate a verbal audio event, which is stored in sound chip 22.

Figure 5:
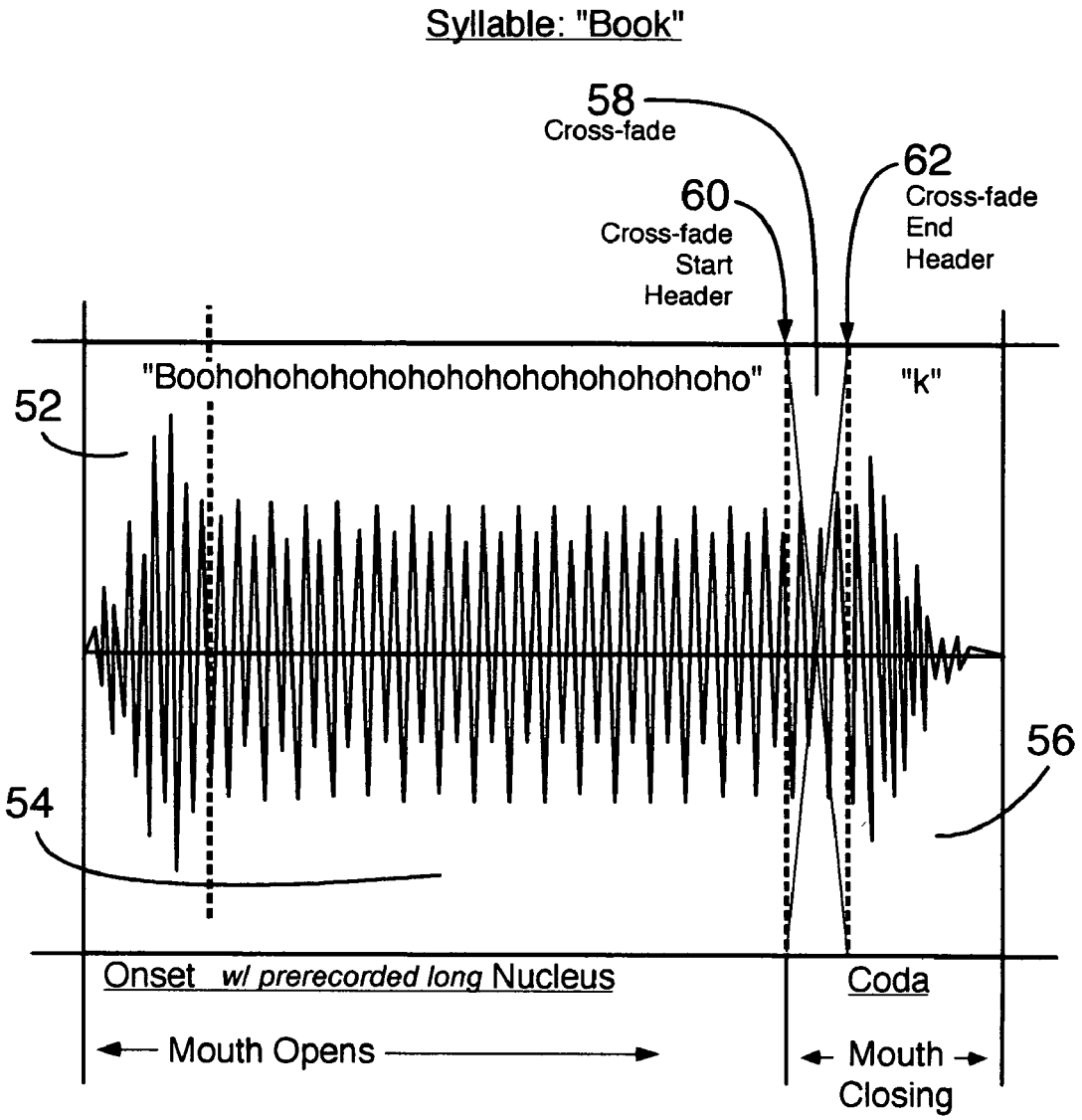
FIG. 5 is a schematic diagram of a verbal audio event in the form of the word "book" generated by the invention.

In one embodiment of the invention, as illustrated in FIG. 5, a verbal audio event, in this example the one-syllable word "book", commences as jaw members 14 and 16 are moved away from each other, simulating the opening of mouth 15. Onset 52, with a sufficiently long prerecorded nucleus 54 of the syllable "book", are heard. As the verbal audio event is ending, in conjunction with the movement of jaw members 14 and 16 towards each other, nucleus 54 jumps (transitions) to cross-fade start header 60, placed at the beginning of coda 56, and performs a smooth audio cross-fade between nucleus 54 and coda 56, that provides a natural-sounding decay of the syllable sound, in a manner similar to the way in which a human voice might sound under the same circumstances. The cross-fade loop 58 has two defined positions, start header 60 and end header 62.

Figure 2:
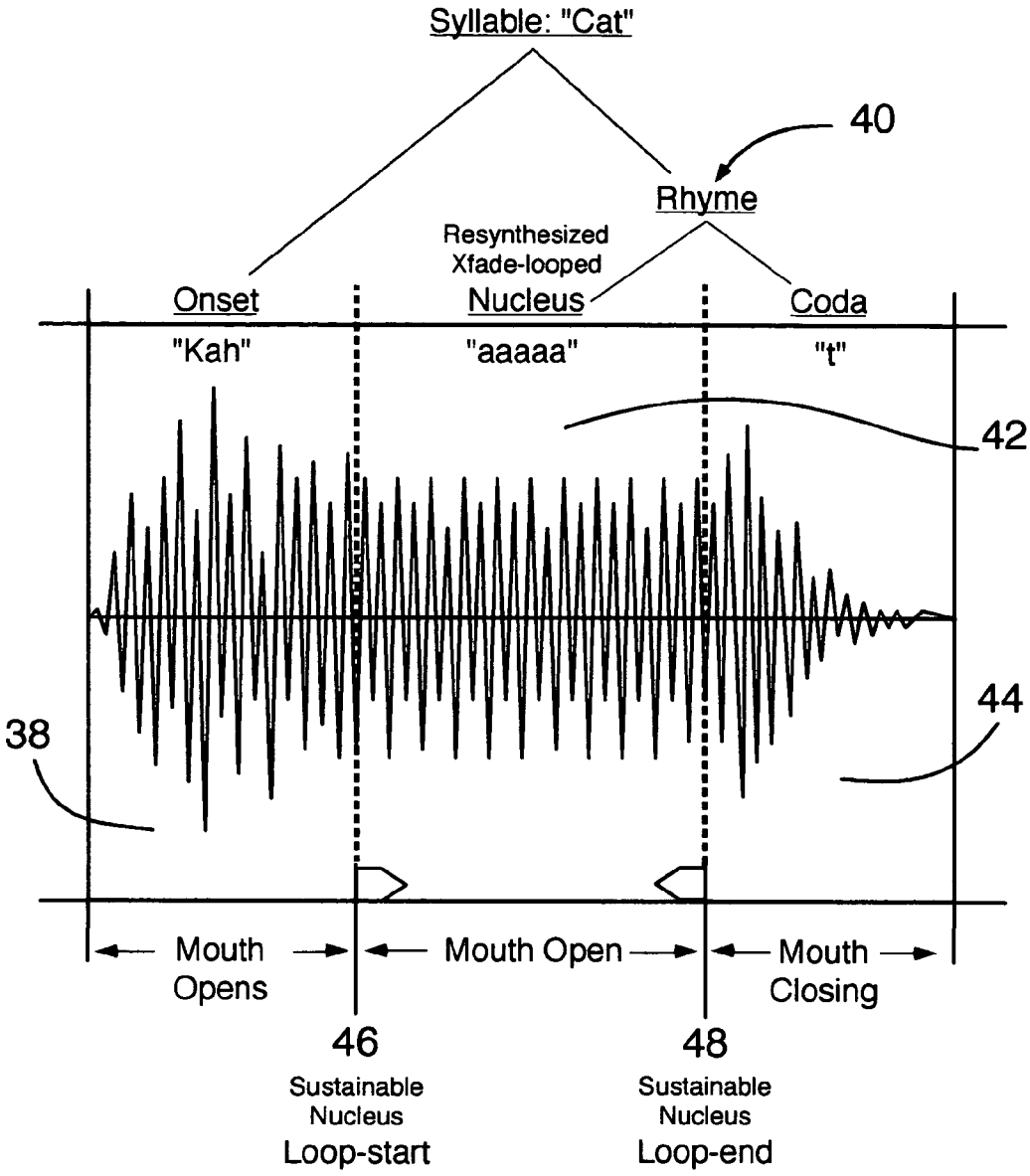
FIG. 2 is a schematic diagram of a verbal audio event in the form of the word "cat" generated by the invention.

FIG. 2 illustrates how a verbal audio event is produced in the present invention, in this example, the one-syllable word "cat". As jaw members 14 and 16 are activated by the user and moved away from each other, simulating the opening of mouth 15, switch 18 activates the first syllable segment, onset 38, the sound "caaa". While mouth 15 remains open, onset 38 is followed smoothly by the second syllable segment, nucleus 42 of rhyme 40, which is looped and oscillates between loop-start header 46 and loop-end header 48, allowing the vowel sound " . . . aaaaaa . . . " for as long as mouth 15 remains open. When the user moves jaw members 14 and 16 adjacent each other, simulating the closing of mouth 15, switch 18 deactivates the loop-end header 48 of nucleus 42, allowing the third syllable segment, coda 44, the sound "t", to smoothly follow and end the syllable in a complete and natural manner.

Figure 4:
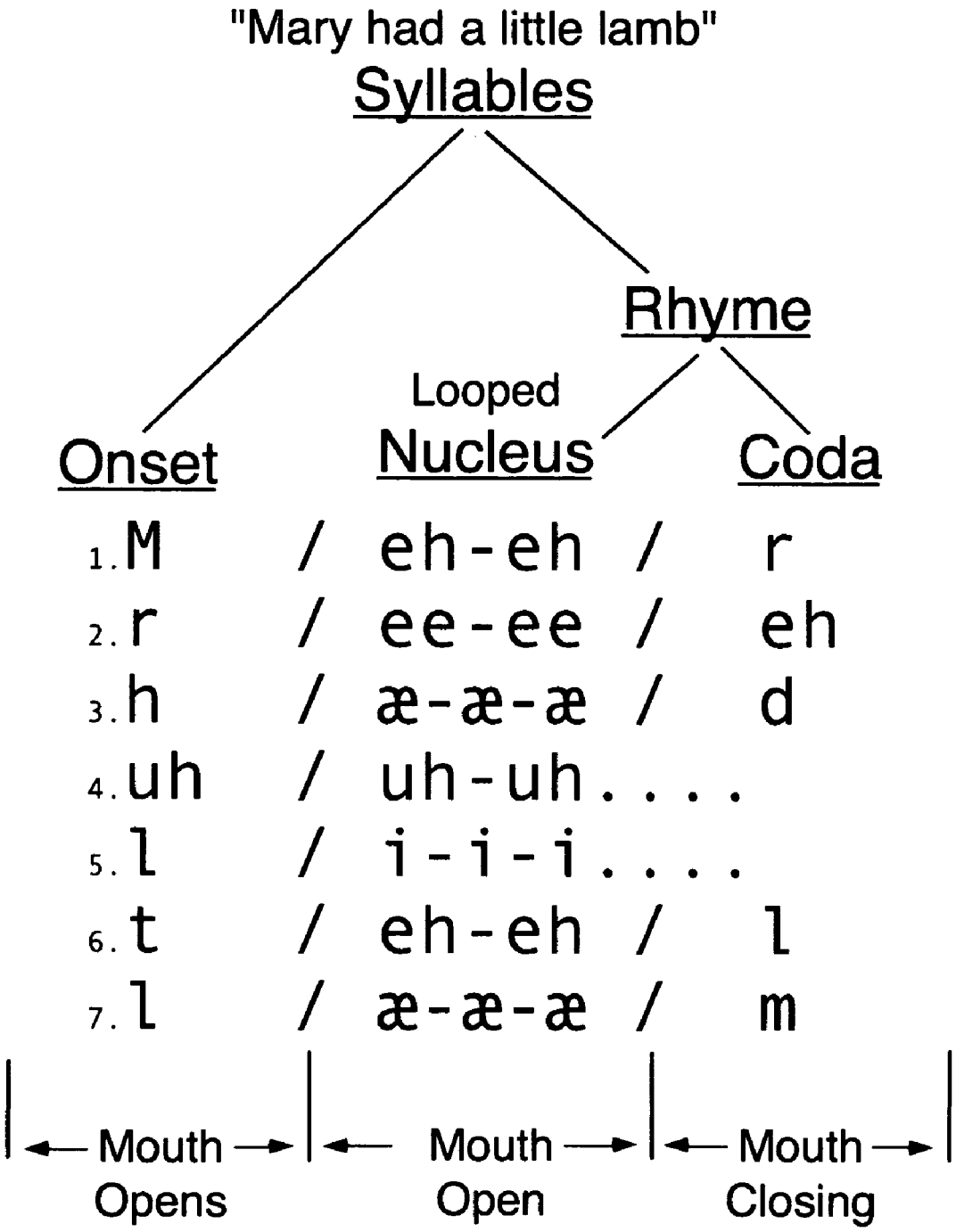
FIG. 4 is a schematic diagram of a sequence of verbal audio events generated by the invention.

As the user continues to open and close jaw members 14 and 16, a sequence of syllables is heard, and familiar words in the form of songs, poems or phrases are "verbalized" by toy 10. A sequence of verbal audio events for the phrase "Mary had a little lamb" is illustrated in the example below and also in FIG. 4. In the example, transitions between the segments of the syllables are indicated by a slash "/", so the complete sequence of the audio events is in the form "xxx/yyyyyy/zzz."

[mouth opens]Meh/eheheh/rrr[mouth closed]-[mouth opens]Ree/eeeee/Eh [mouth closed]-[mouth opens]Ha/ahahah/D[mouth closed]-[mouth opens]Ah/ahahah/H[mouth closed]-[mouth opens]Le/eee/H[mouth closed]-[mouth opens]Tah/ahahah/L[mouth closed]-[mouth opens]La/ahahah/M[mouth closed]

By storing a number of different sequences of audio events in memory 24, a user can enjoy a wide variety of experiences by animating toy 10. Program selection switch 32, which is mounted to head 12, enables the user to select which sequence of verbal audio events he or she would like to hear. In one aspect of the invention, there may be stored several different sequences of the same song in different keys, and/or in second or third-part harmony, allowing the user to change the pitch (the sample playback rate) of each individual syllable sample chromatically or harmonically, rather than recording multiple digital audio versions of the same song in memory 24. Thus, the user can use program selection switch 32 to select the key in which the song is sung, and may also select an optional sequence for second or third part harmony of the same song. Alternatively, chromatic pitch-shifting switch 50 may be added to the sound producing unit 20, to select these options.

One of the advantages of the invention is that the toy can take on a variety of voices. The voices can be animal, fantasy, or human, male or female, young or old, and could also have accents or other characteristics.

Toy 10 also provides great versatility, in that country specific verbal audio events can be stored in memory 24, such as audio events in the Japanese language for use of the invention in Japan, or audio events in the Spanish language for use in many Latin American countries.

In another embodiment of the invention, sound-producing unit 20 includes a sound chip with multiple polyphony, thereby enabling the use of a musical instrumental sequenced performance (i.e., strummed guitar chords, sustained piano chords, or sustained organ chords) synchronized with each audio event. Each chord could be sustained through multiple syllables until the next chord change. The instrumental performances can be generated from a General MIDI PCM or FM sound-bank/digital-audio-engine.

If one or more users has toy 10 on one or both hands, the toys could be used to sing together either in unison or in multiple part harmony, providing yet another entertaining experience for the user(s).

Memory 24 could be manufactured so that it can be removed as a package from the toy 10 and replaced with a new memory that would contain prerecorded audio events that are different from those stored on the removed unit. This way, a user would always be able to have new audio events and would not easily get tired of using the toy.

The types of prerecorded verbal audio events that in sequence produce verbal performances are almost unlimited. I envision prerecorded performances such as vocal effects, educational songs, nursery rhymes, holiday songs, popular songs, animal voices, spoken words, prayers, poems, or robotic speech, among others.

In another embodiment of the invention, a novelty item such as a greeting card could be configured to synchronize verbal audio events in a sound-producing unit mounted to the card. The front and back parts of the greeting card function in the same manner as do the movable jaw members of the toy. As a person begins to open the card, a switch activates the sound producing, which initiates a verbal audio event, which can be sustained while the card is opened and smoothly ends with a natural decay as the parts of the card are closed together.

The foregoing description of exemplary embodiments of the present invention have been presented for purposes of enablement, illustration, and description. It is not intended to be exhaustive of or to limit the present invention to the precise form discussed. There are, however, other configurations for sound producing toys not specifically described herein, but with which the present invention is applicable. The present invention should therefore not be seen as limited to the particular embodiments described herein; rather, it should be understood that the present invention has wide applicability with respect to sound producing toys. Such other configurations can be achieved by those skilled in the art in view of the description herein. Accordingly, the scope of the invention is defined by the following claims.

What is claimed is:

1. A sound producing apparatus, comprising:

a toy, having a head portion including a pair of opposed jaw members movable between a closed first position and an open second position by the user of the toy;

a sound producing unit located in said toy, said sound producing unit including a speaker for outputting audio and further including single or multiple prerecorded syllable verbal audio events of any language or phonetic character; and a switch for selectively actuating said sound producing unit to initiate at least one of said syllable verbal audio events in complete realistic and natural synchronization with the commencement of movement of the jaw members between said first and second positions without said jaw members contacting each other, whereby, each said syllable verbal audio event is terminated in a natural manner by said switch when said jaw members return to said first position, independent of the length of time elapsed in returning said jaw members to said first position.

2. The apparatus according to claim 1, wherein each said syllable verbal audio event further comprises:

a first segment actuated by said switch when said jaw members begin movement between said first position and said second position, the duration of said segment controlled by the user;

a second segment following said first segment said second segment sustained for as long as said jaw members are in said second position; and a third segment following said second segment, said third segment activated by said switch when said jaw members return to said first position, said third segment providing a natural sounding decay to said syllable verbal audio event.

3. The apparatus according to claim 2, wherein said first segment is the onset, said second segment is the nucleus, and said third segment is the coda.

4. The apparatus according to claim 1, further comprising a manual actuator to move said jaw members.

5. The apparatus according to claim 4, wherein each said verbal audio event is in the form of a word having one or more syllables.

6. The apparatus according to claim 1, wherein said toy further includes a body portion.

7. The apparatus according to claim 6, wherein each syllable comprises:

a central peak of sonority; and a plurality of consonants surrounding said central peak of sonority.

8. The apparatus according to claim 1, wherein said jaw members are normally biased in said first position.

9. The apparatus according to claim 1, further comprising a program selection switch.

10. The apparatus according to claim 1, wherein said sound producing unit further includes a plurality of prerecorded audio program events in the form of speech or verbal melody line sequences divided into individual manual controllable syllables.

11. The apparatus according to claim 10, wherein each said verbal melody line sequence further includes a musical instrumental accompaniment performance in synchronization with said verbal melody line sequence.

12. The apparatus according to claim 1, further comprising a chromatic pitch-shifting switch.

13. The apparatus according to claim 1, wherein repeated movement of said jaw members produces recognizable words synchronized with said repeated movement of said jaw members.

14. The apparatus according to claim 1, wherein repeated movement of said jaw members produced recognizable phrases synchronized with said repeated movement of said jaw members.

15. A sound producing apparatus comprising:

a hand covering configured to be worn on a human hand inside a hand puppet;

a sound producing unit located in said hand covering, said sound producing unit including a speaker for outputting audio and further including prerecorded syllable verbal audio events; and a switch for selectively actuating said sound producing unit to initiate at least one of said syllable verbal audio events in response to the movement of the hand in synchronization with the start of movement and continuation of movement of the thumb and fingers of the hand between a closed first position and an open second position without requiring contact between the thumb and fingers, whereby, each said syllable verbal audio event is terminated by said switch when said thumb and fingers return to said first position, independent of the length of time elapsed in returning said jaw members to said first position.

16. The apparatus according to claim 15, wherein each said syllable verbal audio event further comprises:

a first segment actuated by said switch when said jaw members begin movement between said first position and said second position, the duration of said segment controlled by the user;

a second segment following said first segment said second segment sustained for as long as said jaw members are in said second position; and a third segment following said second segment, said third segment activated by said switch when said jaw members return to said first position, said third segment providing a natural sounding decay to said syllable verbal audio event.

17. The apparatus according to claim 15, further comprising a program selection switch.

18. The apparatus according to claim 15, wherein said sound producing unit further includes a plurality of prerecorded audio program events in the form of speech or verbal melody line sequences.

19. The apparatus according to claim 18, wherein each said verbal melody line sequence further includes a musical instrumental accompaniment performance in synchronization with said verbal melody line sequence.

20. The apparatus according to claim 15, further comprising a chromatic pitch-shifting switch.

* * * * *